United States Patent [19]

Towatari et al.

[11] Patent Number: 4,668,925

[45] Date of Patent: May 26, 1987

[54] DIELECTRIC RESONATOR AND METHOD FOR MAKING

[75] Inventors: Yoshishige Towatari; Tetsuo Akoh, both of Tokyo, Japan

[73] Assignee: TDK Corporation, Tokyo, Japan

[21] Appl. No.: 798,394

[22] Filed: Nov. 15, 1985

[30] Foreign Application Priority Data

Nov. 17, 1984 [JP] Japan ..... 59-242619

[51] Int. Cl.[4] ..... H01P 7/00; H01P 7/04; H01P 11/00

[52] U.S. Cl. ..... 333/219; 333/222; 29/600; 204/37.1; 204/38.4

[58] Field of Search ..... 333/202–212, 333/219, 222–229, 234, 235, 243, 248; 29/600, 601; 204/14.1, 30, 37.1, 38.4; 427/58, 126.2

[56] References Cited

U.S. PATENT DOCUMENTS 3,048,495 8/1972 Petkus et al. ..... 427/126.2
3,955,161 5/1976 MacTurk ..... 333/248 X
3,985,851 10/1976 MacTurk ..... 29/600 X
3,993,802 11/1976 Polichette et al. ..... 204/38.4 X
4,259,409 3/1981 Arnold ..... 204/38.4 X
4,454,489 6/1984 Donazzan et al. ..... 333/227
4,506,241 3/1985 Makimoto et al. ..... 333/222

FOREIGN PATENT DOCUMENTS 0151351 11/1979 Japan ..... 333/219

*Primary Examiner*—Paul Gensler
*Attorney, Agent, or Firm*—Oblon, Fisher, Spivak, McClelland & Maier

[57] ABSTRACT

An improved dielectric resonator for high frequency operation having improved unloaded Q is provided which is prepared by forming a first copper coating on the ceramic body to a thickness of 0.2 to 1 μm by electroless plating or vacuum deposition, electrolytic plating a second copper coating on the first coating to a thickness of at least two-fold of the skin depth, and heat treating the thus coated body at 120°–300° C. in a reducing atmosphere or at 700°–1080° C. in a weakly acidic atmosphere.

10 Claims, 9 Drawing Figures

DIELECTRIC RESONATOR AND METHOD FOR MAKING

BACKGROUND OF THE INVENTION

This invention relates to a high frequency dielectric resonator and a method for making the same.

As filters for use in equipment operating with a microwave in the frequency range from several hundred MHz to GHz, a great attention is now paid to dielectric resonators because of small size and high performance.

The dielectric resonator to which the present invention pertains is typically a coaxial dielectric resonator. Such a resonator includes a center-bored cylindrical body having an electrode formed and extending over one end surface and the outer and inner circumferential surfaces. That is, there is formed an electrode having a coaxial dielectric line having an electrically short-circuit surface on one end and an open-circuit surface on the other end. The loss in this type of dielectric resonator is a loss in the dielectric constituting the resonator plus a Joule loss due to high frequency current passing the electrode conductor. It is represented by the following equation, provided that Qu is an unloaded quality factor:

$$1/Qu = 1/Qd + 1/Qc$$

wherein Qd is a dielectric loss and Qc is a conductor loss. In the formula, Qd and Qc generally have values of about 20,000 and about 1,000, respectively. This indicates that the value of Qu largely depends on the value of Qc of the electrode. The conductor loss Qc is, in turn, represented by the equation:

$$1/Qc = \delta(1/a + 1/b)/2ln(b/a)$$

wherein a and b are the inner and outer diameters of the dielectric resonator, respectively, and $\delta$ is the skin depth given by the following equation:

$$\delta = 1/\sqrt{\pi f \mu \sigma}$$

wherein $\sigma$ is the electric conductivity of the metal, $\mu$ is the permeability of the metal, and f is the frequency. This equation indicates that Q of the electrode increases with the electric conductivity of the metal of which the electrode is made. The skin depth $\delta$ varies with frequency f as well as with the conductivity $\sigma$ of the metal. In general, the electrode thickness is made thicker several folds than skin depth $\delta$ to minimize radiation loss.

In the prior art, silver is used to form an electrode on a dielectric body for use at high frequencies such as microwave. A silver coating is generally formed on the surface of a microwave dielectric by transfer coating the surface with silver paste solution using a sponge impregnated therewith and then baking at a temperature of 700° to 900° C. The silver paste solution is a suspension of powder silver dispersed along with glass frit in a solvent having an organic binder dissolved therein. This method suffers from many drawbacks. For example, more working steps are required for coating of the outer, inner and end surfaces with silver paste and the resulting silver coating varies in thickness. A cost problem also arises because expensive silver must be thickly applied in order to achieve a critical coating thickness.

Solid silver in itself has the greatest electric conductivity among metals as demonstrated by its specific resistance of $1.62\times10^{-6}$ ohm-cm. The actual sintered silver coating obtained by applying silver paste solution followed by baking has a film resistivity higher than that of solid silver by a factor of 1.15 to 1.80, which value is higher than the specific resistance of copper of $1.72\times10^{-6}$ ohm-cm.

The silver paste solution also contains glass frit to achieve bonding with dielectric. The presence of glass frit at the interface between the silver film resulting from baking and the dielectric undesirably detracts from the electric conductivity of the skin depth layer which is most closely related to the loss. An additional problem of silver coarse-graining will occur when solder is applied to part of the electrode to complete the circuit.

In place of the above-mentioned method using expensive silver, another method using copper paste was proposed. The copper paste used is prepared by incorporating glass frit, organic binder, and solvent into copper powder and milling the mixture. Although some merits are obtained in material cost, not only the drawbacks associated with the silver paste method remain unsolved in this copper paste method, but the value of Q is further reduced.

It was also proposed to form a copper coating on a ceramic body by electroless plating as disclosed in Japanese Patent Application Kokai No. 54-108544.

It should be noted that the coating must be 5 or 6 $\mu$m or thicker when the skin depth is taken into account. If copper is applied by electroless plating, it is difficult to form a dense and uniform copper coating. The resulting copper coating has a rough surface and a locally varying thickness. Further, many plating blisters frequently occur particularly on the inner circumferential surface of the dielectric resonator. Dielectric resonators having an electrode in the form of an electroless plated copper coating thus have many shortcomings including low electric conductivity $\sigma$, low and widely varying quality factor Q, and low bond strength.

A further attempt was made to eliminate these drawbacks by heat treating the electroless plated copper coating in an inert atmosphere of, for example, nitrogen and argon as disclosed in Japanese Patent Application Kokai No. SHO 58-166806. The heat treatment in an inert atmosphere improves the conductor loss Qc of the electrode and hence, the quality factor Q of the dielectric resonator to some extent. However, since no improvement is expected in film uniformity, denseness, and smoothness, there are achieved only slight improvements in electric conductivity, Q variation, and bond strength, failing to provide satisfactorily stable dielectric resonators.

SUMMARY OF THE INVENTION

It is, therefore, an object of the present invention to provide a dielectric resonator for high frequency operation having an electrode in the form of a film of relatively inexpensive copper and thus having improved film uniformity, denseness, and smoothness as well as bond strength.

Another object of the present invention is to provide such a dielectric resonator having improved unloaded loss with minimized variation as well as improved electric conductivity of the electrode.

A further object of the present invention is to provide a method for producing such a dielectric resonator through relatively less steps using relatively inexpensive copper as the electrode material.

According to a first aspect of the present invention, there is provided a dielectric resonator suitable for high frequency operation comprising a dielectric ceramic body, a first copper coating of 0.2 to 1 μm thick on the ceramic body, and a second copper coating formed on the first coating by electrolytic plating to a thickness of at least two-fold of the skin depth, said first and second copper coatings having been heat treated.

In one preferred embodiment of the dielectric resonator of the present invention, a protective film of organic material is provided on the second coating. In another preferred embodiment, a conductive layer is provided on the second coating.

According to a second aspect of the present invention, there is provided a method for producing a dielectric resonator suitable for high frequency operation comprising the steps of forming a first copper coating on the ceramic body to a thickness of 0.2 to 1 μm, electrolytic plating a second copper coating on the first coating to a thickness of at least two-fold of the skin depth, and heat treating the thus coated body.

BRIEF DESCRIPTION OF THE DRAWINGS

The invention will be more fully understood by reading the following description taken in conjunction with the accompanying drawings, in which.

DETAILED DESCRIPTION OF THE INVENTION

The dielectric resonator of the present invention includes a dielectric ceramic body suitable for high frequency operation. Exemplary of the dielectric ceramic material used herein there may be given $BaO-TiO_2$, $BaO-TiO_2-SnO$, $Sr(Li.Nb)O_3-SrTiO_3$, and $MgTiO_3-CaTiO_3$ base materials. The dielectric ceramic body may be rectangular or cylindrical, and preferably cylindrical. The size and electrode arrangement on the ceramic body may be as usual.

Figure 1:
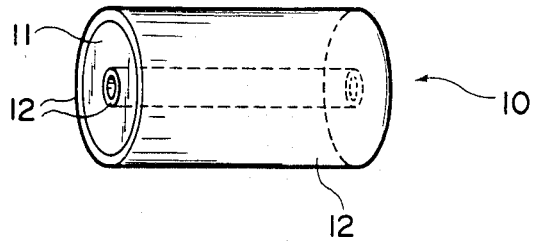
FIG. 1 is a perspective view of a typical dielectric resonator according to one embodiment of the present invention.

Referring to FIG. 1, there is illustrated a typical coaxial dielectric resonator 10. In the embodiment shown in FIG. 1, the dielectric resonator includes a cylindrical ceramic body 11 which is bored at the center and coated with a copper coating 12. The copper coating 12 extends over one end surface and the outer and inner cylindrical surfaces and forms an electrode as will be more precisely described below.

On the dielectric ceramic body for high frequency operation, a first copper coating is formed to a thickness of 0.2 to 1 μm, preferably 0.2 to 0.5 μm. The first copper coating may be formed by any appropriate technique, for example, sputtering, vacuum evaporation, vapor phase deposition and electroless plating. The sputtering and evaporation may be carried out in accordance with the respective conventional vacuum deposition processes. The electroless plating may be carried out after the surface is degreased, roughened with a mixed acid containing hydrofluoric acid, sensitized, and activated. Sensitization may be effected with stannous fluoride and activation with palladium chloride, for example. Then electroless plating is carried out in a plating bath containing copper sulfate, EDTA, formalin, and NaOH.

The first copper coating thinner than 0.2 μm renders unstable the subsequent electrode formation by electrolytic plating. The thickness of the first copper coating need not exceed 1 μm partially because of economic disadvanges that the electroless copper plating is slower than usual electrodeposition and undesirably consumes the plating bath. A longer plating time is thus required and the quantity of product per plating bath life is reduced. In addition, it is rather better to form the skin depth layer by electrolytic plating with an inherently high conductivity.

After the first copper coating has been formed, the second copper coating is formed by electrolytic bright copper plating to a thickness at least twice the skin depth. When the first copper coating is formed by electroless plating, it is preferable to employ a continuous process of electroless plating directly followed by plating without a drying step.

As previously defined, the skin depth δis given by the formula:

$$\delta = 1/\sqrt{\pi f \mu \sigma}$$

and thus depends on the electric conductivity $\sigma$ and the permeability $\mu$ of the overall electrode as well as the frequency f employed. When the thickness of the second copper coating is less than 2δ, the thickness of the resulting electrode is not sufficient to provide a satisfactory Q. It should be noted that the overall electrode preferably has a thickness of at least 2δ, and most preferably at least 3δ. In the case of a dielectric resonator operating at a resonance frequency of 900 MHz, preferably the electrode has a thickness of at least 6.5 μm. No particular upper limit is imposed to the thickness of the overall electrode.

The second copper coating is formed by electrolytic plating because otherwise there result deteriorated uniformity and denseness of the coating, increased electric resistivity and widely varying Q. The electrolytic plating is effected in an ordinary copper plating bath, for example, a copper sulfate bath usually at a current density of 0.5 to 2 $A/dm^2$ for a period of about 20 to 70 minutes. The plating is followed by rinsing and drying as usual.

The dielectric ceramic body having the first and second copper coatings thus formed thereon is ready for use as a dielectric resonator for high frequency operation. However, desirably it is further subjected to a heat treatment in order to reduce the electric conductivity and residual internal stress of the conductor film and to enhance the bond strength thereof. The heat treatment is carried out in a reducing atmosphere containing a reducing gas such as hydrogen and propane in an inert gas such as nitrogen and argon at a temperature of 120° to 300° C. The atmosphere should preferably contain at least 0.2% of the reducing gas. The copper electrode is oxidized at the surface if heat treated in the absence of a reducing gas. Heat treatment at a temperature of lower than 120° C. requires a longer time, resulting in increased production cost. Higher treating temperatures in excess of 300° C. can sometimes reduce the ceramic body.

Alternatively, the heat treatment may be carried out in a weakly oxidizing atmosphere containing about 2 to 25 ppm, prepferably 6 to 10 ppm, of an oxidizing gas such as oxygen in an inert gas such as nitrogen and argon at a temperature of 700° to 1080° C., preferably 750° to 1065° C., and most preferably from 750° C. to lower than the eutectic point, i.e. 1065° C.

Treating temperatures of lower than 700° C. cause the copper coating to be readily oxidized and are difficult to achieve a strong bond between the copper coating and the ceramic body. When the temperature exceeds the eutectic point, especially when it is higher than 1080° C., blisters or bubbles appear on the copper coating.

An oxidizing gas concentration or oxygen partial pressure of less than 2 ppm also inhibits strong bond because such reaction as formation of composite oxides at the interface between oxide ceramic and copper is retarded.

An oxygen concentration of more than 25 ppm results in excessive copper oxidization, which makes the subsequent soldering difficult.

After the first and second copper coatings are formed and preferably heat treated as mentioned above, an organic protective film may preferably be further provided in order to impart corrosion resistance to the copper coatings. Exemplary of the organic protective materials there may be used Evabrite (trade name, manufactured by Tanaka Noble Metal K.K.) and Entech CU-56 (trade name, manufactured by Japan Metal Finishing K.K.).

For the same purpose of imparting corrosion resistance to the first and second copper coatings, an electrically conductive layer may also be provided. The conductive layer may preferably be as thick as 1 to 20 μm. The preferred conductive layer is a solder layer formed by a well-known wet plating process. Also preferred is a combination of a first conductive layer formed of nickel to a thickness of about 1 to 5 μm and a second conductive layer formed of tin to a thickness of about 1 to 20 μm, both by a wet plating process.

The dielectric resonator thus produced by the present invention is effectively used at a resonance frequency in the range of 300 MHz to 5 GHz.

It will be understood that an open electrode pattern may generally be provided by partially abrading the electrode layer after it is formed over the entire surface.

The dielectric resonator and method for making the same according to the present invention have a number of benefits.

According to the first and second aspects of the present invention, even when the electrode is formed to a considerable thickness, it is very dense, uniform, and smooth and variations in electric conductivity and Q are very small. The electrode exhibits an increased bond strength. The Q value is satisfactory.

A good electrode protective effect is achievable when an organic protective layer is provided, and a good corrosion resistance is achievable when an additional conductive layer is provided.

EXAMPLES

Examples of the present invention are given below by way of illustration and not by way of limitation. Qu is unloaded Q.

EXAMPLE 1

A dielectric material intended for high frequency operation was a bored cylindrical ceramic body, as shown in FIG. 1, of $BaTiO_3$—$SnO_2$ having an outer diameter of 10 mm, an inner diameter of 2.7 mm, and a dielectric constant of 40.

At the outset, a first copper coating is formed on the ceramic body by electroless plating to a minimum thickness necessary for the subsequent electrolytic plating, that is, 0.4 μm. The electroless plating was carried out in a bath containing copper sulfate, EDTA-formalin, and NaOH after the ceramic body was degreased, roughened, sensitized with $SnCl_2$, and activated with $PbCl_2$.

After rinsing, the coated ceramic body was electrolytically plated in a bright copper sulfate bath. This dielectric body had a resonance frequency of about 940 MHz and a skin depth δ of 2.16 μm. The plating was carried out at a controlled current density for a selected time such that the thickness of electrodeposited copper was 6.5 μm or more within the bore where the thickness became minimal. After completion of the plating, the plated body was rinsed and dried.

One end surface of the thus plated body was abraded to produce an open-circuit surface, and the body was assembled into a resonator in an ordinary manner by attaching an electrode tap and a lead to the electrode within the bore and the electrode on the short-circuit surface, respectively. This is designated Sample No. 1.

Sample No. 1 was measured for Qu. The results are shown in FIG. 1 where they are referred to "as-plated". Sample No. 1 was found to have a Qu as high as about 700 with less variations.

Sample No. 1 was also measured for electric resistivity. The results are shown in Table 1. A specimen used for the measurement of resistivity was prepared by masking a dielectric substrate except strip-like regions of 1 mm wide by 88 mm long, forming a first copper coating of 0.4 μm thick, and forming a second copper coating thereon by bright electrolytic plating, thereby forming electrode strips of double coating. The electric resistance R of the specimen was measured while the average thickness t of the coating or strip was determined by means of a surface roughness meter. The electric resistivity ρ is calculated in accordance with the equation:

$$\rho = tR/88 \text{ (ohm-cm)}.$$

Sample No. 1 was found to have a very low resistivity of $1.65 \times 10^{-6}$ ohm-cm.

Figure 4A:
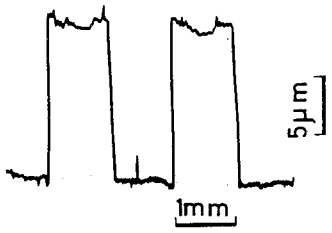
FIGS. 4*a* and 4*b* are diagrams showing the surface roughnesses in transverse and longitudinal directions of a copper electrode prepared in Example 1 according to the present invention, respectively.
Figure 4B:
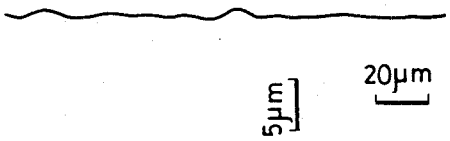

A specimen of a dielectric substrate having electrode strips of double coating deposited thereon which was the same as used in the resistivity measurement was determined for surface roughness by scanning a surface roughness meter in transverse and longitudinal directions. The surface roughnesses in the transverse and longitudinal directions are shown in FIGS. 4*a* and 4*b*, respectively. It is demonstrated that the coating on the sample is very uniform, dense, and smooth.

The bond strength of the electrode was determined by the following test. One end of a copper wire having a diameter of 0.5 mm was worked into a nail head form. The nail head formed wire end was soldered onto a copper electrode on the end surface of a dielectric body. The solder area had a diameter of 2.0 to 2.5 mm. The dielectric body was fixed in a jig and the soldered wire was pulled in its longitudinal direction at a rate of 50 mm/min. to measure the strength at break. The strength at break was 0.5 kg, indicating a high bond strength.

EXAMPLE 2

Sample No. 2 was prepared by forming an electrode by the same procedure as Example 1 except that the electroless plated layer was replaced by an evaporated layer.

Sample No. 2 was measured to have an electric resistivity of $1.63\times10^{-6}$ ohm-cm and a bond strength of 1.2 kg. The Qu value and its variation and surface roughness of Sample No. 2 were substantially equal to those of Sample No. 1.

EXAMPLE 3

A dielectric body intended for microwave operation was coated by electroless copper plating and bright electrolytic copper plating in the same manner as in Example 1.

The plated body was then annealed at different temperatures in the range of 120° to 300° C. in a reducing atmosphere containing 1% hydrogen such that the copper might not be oxidized. Thereafter, the annealed body was assembled into a resonator in the same manner as in Example 1.

Figure 2:
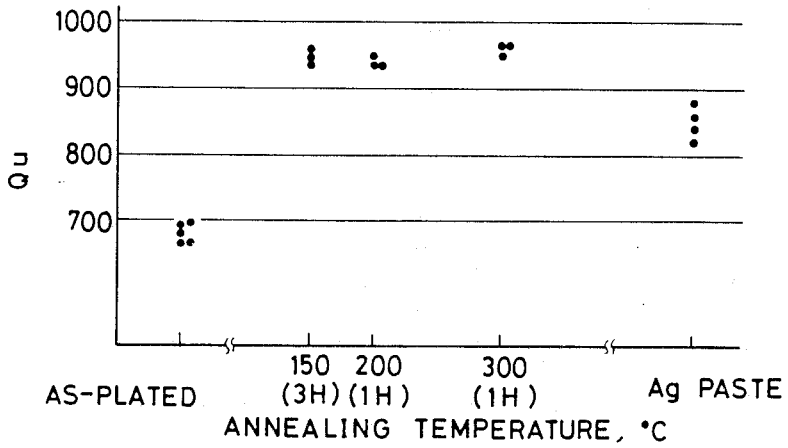
FIG. 2 is a diagram showing Qu of resonators as a function of annealing temperature in a weakly reducing atmosphere.

The Qu of this sample was measured. The results are shown in FIG. 2 where the heat treating temperatures were 150°, 200°, and 300° C. Some Qu variants of the dielectric resonators at different annealing temperatures are shown in FIG. 2 along with the Qu value of a prior art dielectric resonator using a silver paste.

It is evident from FIG. 2 that a heat treatment at temperatures of from 120° to 300° C. increases Qu by annealing the plated copper coating. The Qu values of the annealed electrodes are higher than those of the prior art silver paste.

Annealing temperatures of 120° C. or higher are desirable because lower temperatures inconveniently take a long time to anneal. For certain dielectric compositions, dielectric bodies can be reduced at annealing temperatures in excess of 300° C. in a reducing atmosphere. Thus the annealing temperature in a reducing atmosphere is sufficient and optimum in the range of 120° to 300° C.

In general, coatings as plated have a residual internal stress. For example, the electrolytic copper platings were measured to have an internal stress of 10.6 kg/mm$^2$. After a heat treatment at 120° C. for 3 hours, the internal stress was reduced to 0.2 kg/mm$^2$, that is, substantially eliminated. The coppler platings are almost annealed by such a heat treatment.

The data in FIG. 2 shows that a heat treatment increases Qu with less variation.

Sample No. 3, when heat treated at 200° C., was measured to have an electric resistivity of $1.65\times10^{-6}$ ohm-cm and a bond strength of 0.7 kg. The surface roughness was substantially equal to that of Sample No. 1.

EXAMPLE 4

A dielectric body intended for microwave operation was coated by electroless copper plating and bright electrolytic copper plating in the same manner as in Example 1.

The plated body was then baked at different temperatures in the range of 700° to 1000° C. in a humidified, weakly oxidizing atmosphere containing 5 to 25 ppm oxygen in nitrogen. Thereafter, the baked body was assembled into a resonator in the same manner as in Example 1.

Figure 3:
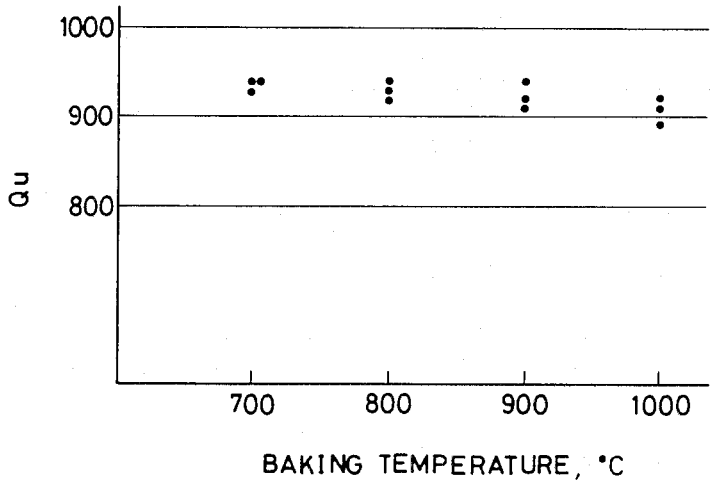
FIG. 3 is a diagram showing Qu of resonators as a function of baking temperature in a weakly oxidizing atmosphere.

The Qu of this sample was measured. The results are shown in FIG. 3 where the heat treating temperatures were 700°, 800°, 900°, and 1000° C. The Qu values of the baked electrodes are higher than those of the prior art silver paste.

The baking atmosphere was selected to be weakly acidic in order that an intermediate layer of cuprous oxide $Cu_2O$ be formed at the interface between the dielectric and the copper electrode. Then an increase in bond strength is expectable. Actually, the bond strength was measured to be 7 kg or higher.

Since copper has the melting point of 1083° C., the upper limit of 1083° C. is imposed to the baking temperature. Copper can inconveniently be oxidized at baking temperatures of lower than 700° C.

Sample No. 4, when heat treated at 800° C., was measured to have an electric resistivity of $1.63\times10^{-6}$ ohm-cm. The surface roughness was substantially equal to that of Sample No. 1.

Thirty (30) copper electrode microwave dielectric resonators prepared as above were examined for reliability by various tests including vibration, impact, thermal cycling, and high temperature impact tests. No defective was noted.

COMPARATIVE EXAMPLE 1

This example is in accord with a prior art electrode forming method. A silver paste solution was screen printed on a smooth dielectric substrate and baked in air at 800° C., producing a silver film of 7.2 μm thick, designated Sample No. 5.

Sample No. 5 was measured for electric resistivity, Qu, and surface roughness by the same procedures as in Example 1. The electric resistivity was $2.18\times10^{-6}$ ohm-cm. The Qu values are shown in FIG. 2.

Figure 6A:
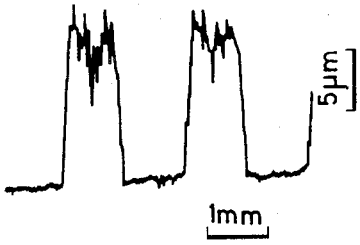
FIG. 6a PRIOR ART
FIGS. 6*a* and 6*b* are diagrams showing the surface roughnesses in transverse and longitudinal directions of a silver electrode prepared by conventional silver paste application, respectively.
Figure 6B:
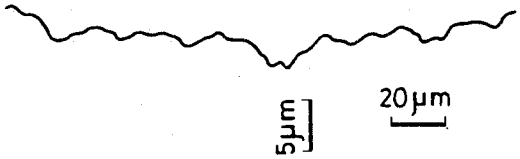
FIG. 6b PRIOR ART

The surface roughnesses in transverse and longitudinal directions are shown in FIGS. 6*a* and 6*b*.

COMPARATIVE EXAMPLE 2

This example is in accord with a prior art electrode forming method. A copper paste was prepared by mixing and milling copper powder, glass frit, organic binder and solvent. The copper paste was screen printed on a smooth dielectric substrate in the same manner as for Sample No. 5, heated at 400° C. in air to evaporate off the solvent, and baked in nitrogen gas at 800° C., producing a copper film of 6.1 μm thick, designated Sample No. 6.

Sample No. 6 was measured for electric resistivity, Qu, and surface roughness by the same procedures as in Example 1. The electric resistivity was as high as $2.63\times10^{-6}$ ohm-cm. The surface roughness was substantially the same as Sample No. 5.

COMPARATIVE EXAMPLE 3

A dielectric substrate over the entire surface was coated with copper by electroless plating, providing Sample No. 7.

Figure 5A:
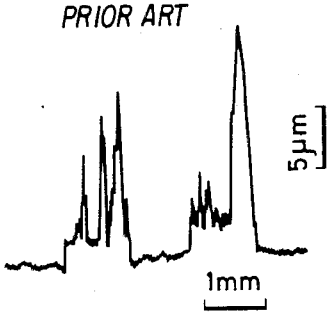
FIG. 5a PRIOR ART
FIGS. 5*a* and 5*b* are diagrams showing the surface roughnesses in transverse and longitudinal directions of a copper electrode prepared by conventional electroless plating, respectively.
Figure 5B:
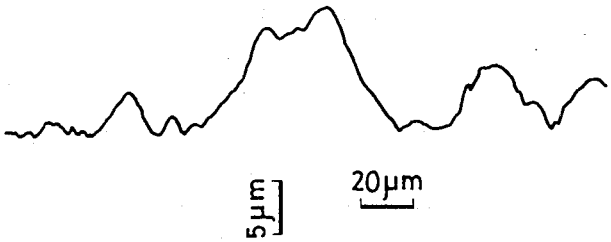
FIG. 5b PRIOR ART

Sample No. 7 was measured to have an electric resistivity of $3.43\times10^{-6}$ ohm-cm and a bond strength of 0.5 kg. FIGS. 5*a* and 5*b* show the surface roughnesses in transverse and longitudinal directions measured in the same manner as in Example 1, respectively. The electroless plated copper coating was found to be remarkably rought at the surface, less dense, less uniform, and less smooth with widely varying Qu.

COMPARATIVE EXAMPLE 4

Sample No. 8 was prepared by heat treating Sample No. 7 at 700° C. in a nitrogen atmosphere. It was measured to have an electric resistivity of $2.86\times10^{-6}$ ohm-cm and its surface roughness was unchanged from that of Sample No. 7.

The properties of these electrodes are shown in Table 1.

TABLE I

| Sample No. | Electrode formation | Thickness μm | Resistance m | Resistivity $\times10^{-6}$ Ω-cm |
|---|---|---|---|---|
| 1 | electroless plating 0.4 μm + electrolytic plating | 14.5 | 100 | 1.65 |
| 2 | evaporation 0.4 μm + electrolytic plating | 14.5 | 99 | 1.63 |
| 3 | 1 + reducing heat treatment | 14.5 | 100 | 1.65 |
| 4 | 1 + weakly oxidizing heat treatment | 14.5 | 99 | 1.63 |
| 5 | Ag paste | 12 | 160 | 2.2 |
| 6 | Cu paste | 13 | 178 | 2.6 |
| 7 | electroless Cu plating | 3 | 1005 | 3.4 |
| 8 | electroless Cu plating + heat treatment | 3 | 838 | 2.9 |

As evident from the data in Table I, the copper coatings of the present invention have a low resistivity which is approximate to the specific resistance of copper. The bond strength of the electrode to the dielectric body is sufficiently great. These advantages of the present invention are further enhanced by providing an organic protective film or a solder layer or a conductive layer consisting of a first nickel layer and a second tin layer on the copper coating.

Since a dense, uniform, smooth copper coating having a low film resistivity can be formed on a microwave dielectric body by bright electrolytic copper plating according to the present invention, an improved dielectric resonator having an increased Q value is obtained. With respect to the electrode producing process, plating and annealing or baking are suitable for mass production so that a substantial reduction in man-hours is expectable. The use of copper as the electrode material offers a great saving of material cost.

Although the present invention is described and claimed as a dielectric resonator, it is equally applicable to ceramic substrates for microwave operation.

We claim:

1. A dielectric resonator suitable for high frequency operation comprising a dielectric ceramic body, a first copper coating of 0.2 to 1 μm thick on the ceramic body, and a second copper coating formed on the first coating by electrolytic plating to a thickness of at least two-fold of the skin depth at the frequency of operation, said first and second copper coatings having been heat treated after both coatings are applied to said ceramic body.

2. A dielectric resonator according to claim 1 which further comprises a protective film of organic material on the second coating.

3. A dielectric resonator according to claim 1 which further comprises a conductive layer on the second coating.

4. A dielectric resonator according to claim 3 wherein the conductive layer is a solder layer.

5. A dielectric resonator according to claim 3 wherein the conductive layer comprises a first conductive layer of nickel applied to the second coating and a second conductive layer of tin applied thereto.

6. A method for producing a dielectric resonator suitable for high frequency operation comprising the steps of forming a first copper coating on a ceramic body to a thickness of 0.2 to 1 μm, electrolytic plating a second copper coating on the first coating to a thickness of at least two-fold of the skin depth at the frequency of operation, and heat treating the thus coated body.

7. A method according to claim 6 wherein the first copper coating is formed by electroless plating.

8. A method according to claim 6 wherein the first copper coating is formed by vapor phase deposition.

9. A method according to claim 6 wherein the heat treatment is carried out at 120° to 300° C. in a reducing atmosphere.

10. A method according to claim 6 wherein the heat treatment is carried out at 700° to 1080° C. in a weakly oxidizing atmosphere.

* * * * *